US007128031B2

(12) United States Patent
Shirakami et al.

(10) Patent No.: US 7,128,031 B2
(45) Date of Patent: Oct. 31, 2006

(54) LEAD AIR CONTROL APPARATUS OF STRATIFIED SCAVENGING TWO-CYCLE ENGINE

(75) Inventors: Kazuo Shirakami, Saitama (JP); Masaaki Sugiyama, Saitama (JP)

(73) Assignee: Komatsu Zenoah Co., Saitama (JP)

( * ) Notice: Subject to any disclaimer, the term of this patent is extended or adjusted under 35 U.S.C. 154(b) by 0 days.

(21) Appl. No.: 10/524,904

(22) PCT Filed: Dec. 19, 2003

(86) PCT No.: PCT/JP03/16316

§ 371 (c)(1),
(2), (4) Date: Feb. 17, 2005

(87) PCT Pub. No.: WO2004/057169

PCT Pub. Date: Jul. 8, 2004

(65) Prior Publication Data

US 2006/0060157 A1 Mar. 23, 2006

(30) Foreign Application Priority Data

Dec. 20, 2002 (JP) ..... 2002-369730

(51) Int. Cl.
*F02B 33/04* (2006.01)
*F02F 1/22* (2006.01)

(52) U.S. Cl. ..... 123/73 PP; 123/65 A

(58) Field of Classification Search ..... 123/73 R, 123/73 A, 73 PP, 65 A
See application file for complete search history.

(56) References Cited

U.S. PATENT DOCUMENTS 4,075,985 A 2/1978 Iwai
6,289,856 B1 9/2001 Noguchi
6,328,288 B1 12/2001 Gerhardy
6,367,432 B1 * 4/2002 Araki ..... 123/73 R
6,401,672 B1 6/2002 Raffenberg et al.
6,401,673 B1 6/2002 Linsbauer et al.
6,415,750 B1 7/2002 Rosskamp et al.
6,595,168 B1 7/2003 Araki
6,640,755 B1 11/2003 Araki

FOREIGN PATENT DOCUMENTS

JP 55-4518 1/1980
JP 9-112360 4/1997
JP 2000-18453 1/2000
JP 2000-186559 7/2000
JP 2000-314350 11/2000
JP 2000-328945 11/2000

(Continued)

*Primary Examiner*—Noah P. Kamen
(74) *Attorney, Agent, or Firm*—Everest Intellectual Property Law Group; Michael S. Leonard

(57) ABSTRACT

In an insulator (21) inserted between a carburetor (30) and a cylinder (3) for a purpose of insulating heat, there are formed an intake passage (22) connected to the carburetor (30), and a pair of first air passages (23) connected to respective air flow paths (14) communicated with a pair of scavenging ports (10) formed in the cylinder (3). Air control valves (25) are respectively provided within a pair of first protruding portions (33) communicating with an air cleaner (32), and are connected to the pair of first air passages (23) via a pair of connection members (35). Portions from the air passages within the pair of first protruding portions (33) to the pair of first air passages (23) are respectively formed as smooth air passages in which a change of an inner diameter cross sectional area in a connection portion is small.

10 Claims, 9 Drawing Sheets

FOREIGN PATENT DOCUMENTS

| | | |
|---|---|---|
| JP | 2001-263073 | 9/2001 |
| JP | 2001-263164 | 9/2001 |
| JP | 2002-054443 | 2/2002 |
| JP | 3313373 | 5/2002 |
| JP | 2002-227653 | 8/2002 |
| JP | 2001-263072 | 9/2002 |
| JP | 2002-535546 | 10/2002 |
| WO | WO 00/43650 | 7/2000 |

* cited by examiner

PRIOR ART FIG. 9
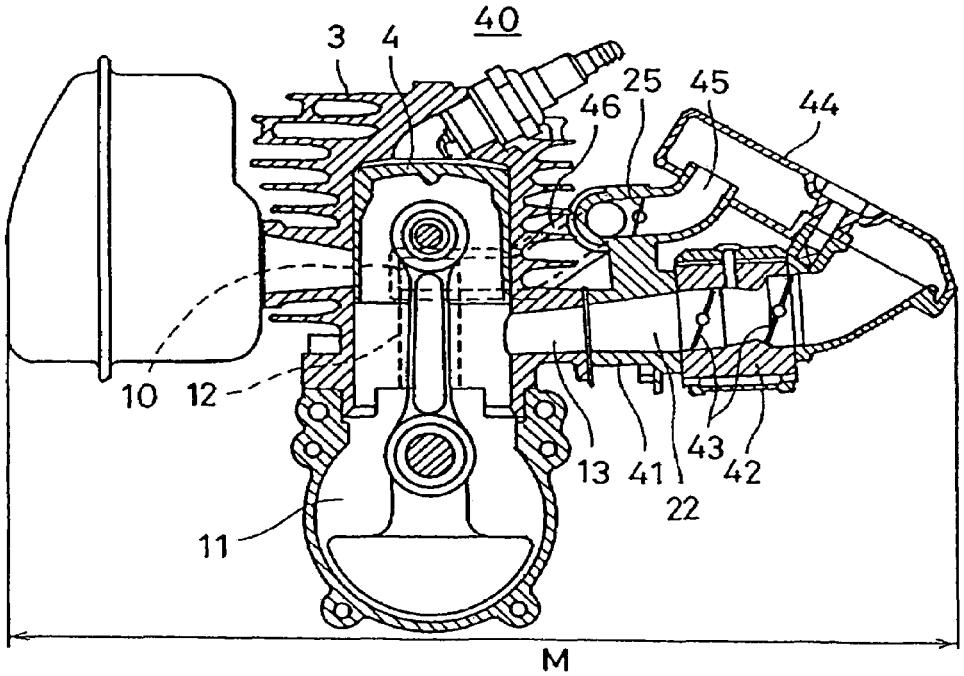

LEAD AIR CONTROL APPARATUS OF STRATIFIED SCAVENGING TWO-CYCLE ENGINE

TECHNICAL FIELD

The present invention relates to a lead air control apparatus for controlling an air amount of a lead air for scavenging of a stratified scavenging two-cycle engine.

BACKGROUND ART

In conventional, there has been proposed various configurations as a stratified scavenging two-cycle engine having an air control valve controlling an air amount of a scavenging lead air. For example, there has been proposed a lead air control apparatus of a stratified scavenging two-cycle engine, as described in Japanese Patent Application Laid-Open (JP-A) No. 2000-328945.

The lead air control apparatus described in JP-A No. 2000-328945 is shown in FIG. 9. As shown FIG. 9, in a stratified scavenging two-cycle engine 40, a pair of scavenging ports 10 are provided in opposing both side surface portions, on an inner wall surface of a cylinder 3 to which a piston 4 is slidably fitted, and a pair of scavenging ports 10 are respectively connected to a crank chamber 11 by scavenging flow paths 12.

A carburetor 42 is attached to an intake port 13 provided in the cylinder 3 via an insulator 41 aiming at a heat insulation, and an intake side of the carburetor 42 is connected to an air cleaner 44. The carburetor 42 is provided with a butterfly type throttle valve 43. The insulator 41 is provided with an intake passage 22 connecting the intake port 13 and the carburetor 42, and an air passage 45 for the lead air.

One side of the air passage 45 for the lead air is connected to the air cleaner 44, and the other end thereof is formed in a fork shape so as to be branched into right and left sides, which are respectively connected to the pair of scavenging ports 10 and the scavenging flow paths 12 via connection pipes 46. A butterfly type air control valve 25 controlling the air amount of the lead air is provided in an upstream side of the branch point of the air passage 45, and is configured such as to work with the throttle valve 43 of the carburetor 42.

Accordingly, it is possible to attach the air control valve 25 within a limited space, it is possible to make an entire length M of the engine short, and it is possible to achieve a compact and light configuration.

However, in the configuration described in JP-A No. 2000-328945, the air control valve is provided in the air passage arranged in the insulator, the air passage is branched into the right and left sides in a downstream portion of the air control valve, and the branched air passages are respectively connected to the pair of scavenging ports and a pair of scavenging flow paths which are provided in the left and right sides of the cylinder of the engine. Accordingly, the configuration of the insulator is complicated, and the length of the insulator is elongated, and a large area product is required. As a result, an outer diameter of the engine is increased.

Further, a configuration for easily forming the air passage can be achieved by forming the air passage formed within the insulator approximately in a linear shape. Accordingly, when the air passage is configured so as to be branched into the right and left sides within the insulator, it becomes complicated to form the branched air passage, and an elbow shape, that is, a shape in which the linear air passages cross, is formed at the branch portion in the air passage. If the air passage is formed in a sharply bent shape at the branch portion, there is a problem that the air flow in the bent portion forms a flow in which a vortex flow is generated by being peeled off from the inner wall of the air passage, whereby an air resistance is increased.

DISCLOSURE OF THE INVENTION

The present invention is made by taking the problem mentioned above into consideration, and an object of the present invention is to provide a lead air control apparatus of a stratified scavenging two-cycle engine in which a flow resistance of a lead air is small, and a simple and compact configuration is achieved.

In order to achieve the object mentioned above, according to a most principal aspect of the present invention, there is provided a stratified scavenging two-cycle engine comprising: a pair of first air passages formed in an insulator inserted between a carburetor and a cylinder for a purpose of heat insulation, and respectively connected to a pair of scavenging ports provided in the cylinder; a pair of second air passages respectively connecting between an air cleaner and the respective first air passages, and arranged in an approximately parallel state; and an air control valve controlling an air amount of a lead air for scavenging.

Accordingly, it is possible to configure the air passage of the lead air formed by connecting the pair of second air passages respectively provided with the air control valves to the pair of first air passages formed in the insulator, as the approximately parallel arranged air passages. Further, it is not necessary that the air passage for the lead air is configured such that the passage is branched into right and left sides by arranging the branch portion in the middle of the air passage. Further, as the air passage formed within the insulator, the first air passages can be formed as a pair of independent air passages.

Accordingly, it is not necessary to form the sharply bent elbow portion within the air passage of the lead air. Further, since the sharply bent elbow portion does not exist within the air passage of the lead air, it is possible to smoothly circulate the air within the air passage of the lead air, and it is possible to reduce the air resistance within the air passage of the lead air. Further, it is possible to improve an engine performance by reducing an air resistance within the air passage of the lead air.

Further, it is possible to simplify the configuration of the first air passage within the insulator, and it is possible to make the shape of the insulator compact. Accordingly, it is possible to configure an entire stratified scavenging two-cycle engine compact.

Further, it is possible to arrange the intake passage from the carburetor and a pair of air passages of the lead air in a definitely sorting state. Accordingly, it is possible to prevent the air passage of the lead air and the intake passage from the carburetor from crossing each other in the middle, and it is possible to prevent a pair of air passages of the lead air from being arranged in both sides of the intake passage of the carburetor, whereby the entire stratified scavenging two-cycle engine can be configured so as to be simple and compact.

In particular, it is possible to form the first air passage on the same plane as the scavenging port, by arranging the air passage of the lead air above the intake passage from the carburetor, and it is possible to configure the air passage and the intake passage in a smooth connection state having a small air resistance. Accordingly, it is possible to keep the entire length of the piston low, and to configure the entire length of the engine low, whereby the engine can be configured so as to be compact.

According to a main aspect of the present invention, the air control valve is provided near the air cleaner or is integrally formed with the air cleaner, a connection member connected to each of the first air passages is provided in each of the second air passages, and an inner peripheral wall of the air passage from each first air passage up to each second air passage is formed smoothly and continuously along a length direction of the air passage.

Accordingly, owing to the interposition of the connection member, even if the connecting positions of the first air passage and the second air passage are different, the first air passage and the second air passage can be configured as the smooth continuous passages by the connection member. Further, since the inner peripheral wall of the air passage from each first air passage to each second air passages is formed smoothly and continuously along the length direction of the air passage, it is possible to reduce the air resistance of the lead air within the air passage.

Since the first air passage and the second air passage are configured so as to have the arrangement mentioned above, it is possible to expand an interval between the connection position of the second air passage and the air cleaner, and the connection position of the carburetor and the air cleaner, so that a large size air cleaner can be used as the air cleaner. Accordingly, the large size air cleaner can be used for a small size engine by connecting the large size air cleaner to the small size engine, in which an intake port for an air-fuel mixture and an air flow path for a lead air are arranged at close positions.

Further, since the connection member is employed for connecting the each first air passage and each second air passage, the configuration of the insulator is simple, and it is possible to manufacture the insulator compact and at a low cost. Further, it is possible to configure the entire stratified scavenging two-cycle engine compact, by forming the insulator compact.

According to a main aspect of the present invention, a connection portion in an end portion of the connection member is formed such that a change of an internal diameter cross sectional area is small between the connection portion and a connected portion.

Accordingly, it is possible to connect the connection member and a connected portion in a state in which the change of the inner diameter cross sectional area is small between the connection member side and the connected portion side, in the connection portion between an end portion of the connection member and the connected portion. Further, it is possible to smoothly and continuously form the inner peripheral wall of the air passage from each first air passage to each second air passage along the length direction of the air passage.

According to a main aspect of the present invention, the connection member has a flexibility. Accordingly, since the connection member has the flexibility, it is possible to configure the first air passage and the second air passage as the smooth and continuous passage by the connection member in a simple and easily assembled manner, even if the connection positions of the first air passage and the second air passage are different.

According to a main aspect of the present invention, the respective first air passages are arranged so as to be approximately parallel to each other, and are formed as approximately linear air passages.

Accordingly, since it is possible to form the first air passage formed in the insulator as the independent approximately linear air passage, it is possible to form the first air passage in the insulator easily. Further, since the first air passage and the second air passage are connected by the connection member having the flexibility, it is possible to increase a freedom of selecting the position at which an inlet is formed in the first air passage, and it is possible to easily configure the insulator.

As a result, it is possible to simplify the configuration of the entire stratified scavenging two-cycle engine, and it is possible to configure the engine compact. Further, it is possible to configure the air passage of the lead air as the smooth air passage having the small air resistance.

The approximately linear air passage involves an air passage shape in which a center axial line of an air passage is formed in an approximately linear shape such as an air passage shape in which an inner diameter within the air passage is expanded from an upstream side toward a downstream side, an air passage shape in which the inner diameter is inversely compressed from the upstream side toward the downstream side, and the like, in addition to the air passage in which the inner diameter is entirely uniform.

According to a main aspect of the present invention, each first air passage has an air flow path formed within the cylinder, and the pair of air flow paths and the pair of scavenging ports are arranged so as to be connectable on the same plane.

Accordingly, it is possible to communicate the air flow path formed within the cylinder in the air passage of the lead air, with the scavenging port formed within the cylinder on the same plane, and it is possible to linearly connect from the air flow path to the scavenging port.

The air flow path can be configured so as to be directly connected to the scavenging port within the cylinder. Further, the air flow path can be configured by the first air flow path formed within the cylinder and the second air flow path formed on an outer peripheral surface of the piston.

When the air flow path is formed by the first air flow path and the second air flow path, the first air flow path and the scavenging port are connected at a time when the operating position of the piston comes to a position in which the second air flow path connects the first air flow path and the scavenging port. At this time, since the first air flow path and the scavenging port are arranged on the same plane, it is possible to achieve a linear arrangement relation from the first air flow path to the scavenging port via the second air flow path.

Accordingly, it is possible to make the flow of the lead air from the air flow path to the scavenging port in a smooth flow state, and it is possible to make the lead air to flow into the scavenging port from the air flow path in a state of keeping the smooth flow state. Further, it is possible to fill a sufficient amount of lead air into the cylinder from the scavenging port. Further, it is possible to keep the entire length of the piston low and to configure the entire length of the engine low, so that it is possible to configure the engine compact.

If the air flow path and the scavenging port are not arranged on the same plane, the flow of the lead air from the air flow path to the scavenging port forms a flow curving in a vertical direction. Accordingly, there is generated a problem that it is necessary to elongate the entire length of the piston at an energy loss generated due to the flow curving in the vertical direction and a degree that the air flow path is formed so as to be curved in the vertical direction.

BRIEF DESCRIPTION OF THE DRAWINGS

FIG. 9 is a front elevational cross sectional view of a stratified scavenging two-cycle engine provided with a lead air control apparatus according to a prior art.

BEST MODE FOR CARRYING OUT THE INVENTION

Hereinafter, embodiments of a lead air control apparatus of a stratified scavenging two-cycle engine according to the present invention are explained with reference to the accompanying drawings. In the meantime, the present invention is not limited to the embodiments described below and involves a technical region which those skilled in the art can easily modify based on the embodiments, as a matter of course.

Figure 1:
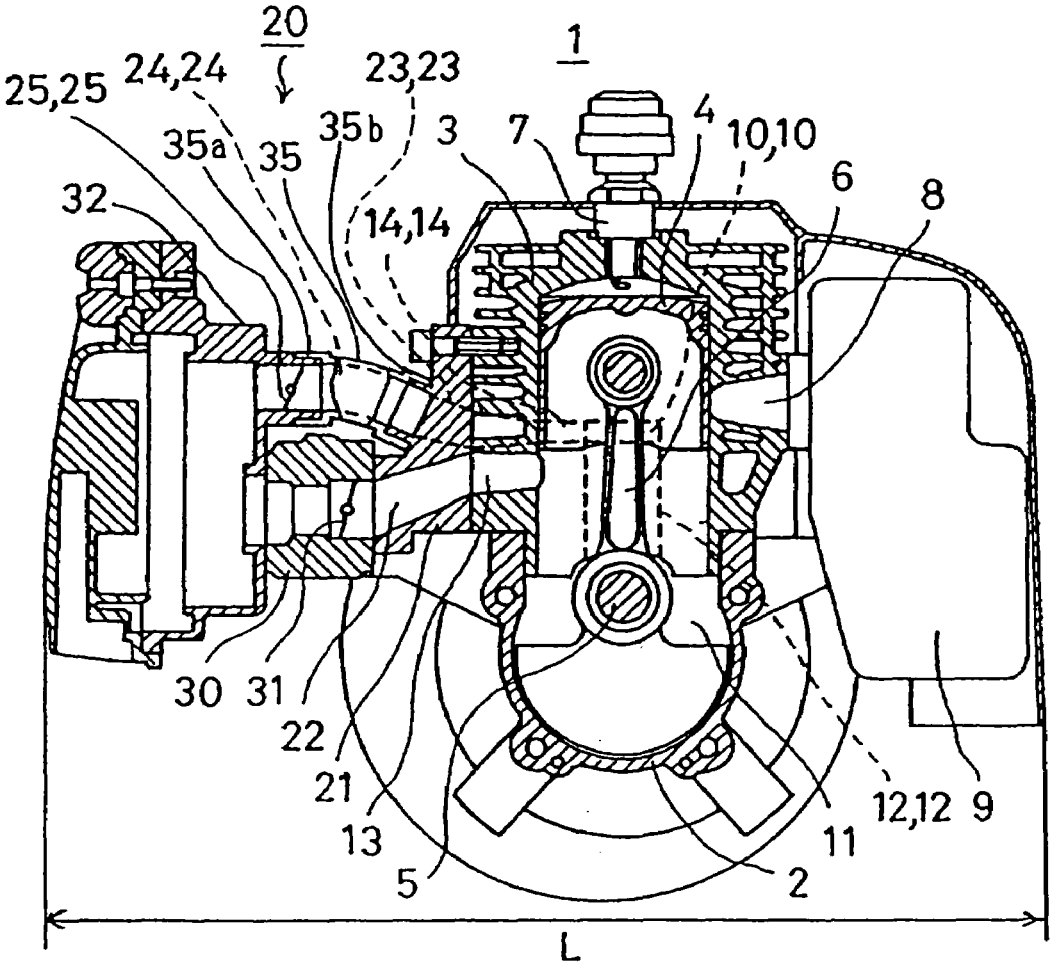
FIG. 1 is a front elevational cross sectional view of a stratified scavenging two-cycle engine provided with a lead air control apparatus according to the present invention.

FIG. 1 is a front elevational cross sectional view of a stratified scavenging two-cycle engine 1 comprising a lead air control apparatus 20 according to the present invention. In FIG. 1, a piston 4 is slidably fitted to a cylinder 3 attached to an upper portion of a crank case 2, and a crank shaft 5 rotatably attached to the crank case 2 and the piston 4 are connected by a connecting rod 6.

A spark plug 7 is attached to a top portion of the cylinder 3. A muffler 9 is attached to an exhaust port 8 provided on a wall surface of the cylinder 3. A pair of scavenging ports 10, 10 introducing a lead air into the cylinder are provided at opposing positions in both side surfaces having an angle of approximately 90° in a plan view with respect to the exhaust port 8, in a slightly lower side of the exhaust port 8 provided on the wall surface of the cylinder 3.

The scavenging ports 10, 10 and a crank chamber 11 are connected by scavenging flow paths 12, 12 respectively communicating with a pair of scavenging ports 10, 10. The scavenging flow paths 12, 12 are formed in the cylinder 3.

An intake port 13 is provided at a position opposing to the exhaust port 8, in a slightly lower side of the scavenging port 10 on the wall surface of the cylinder 3. A pair of air flow paths 14, 14 respectively connected to the pair of scavenging ports 10, 10 are open in the vicinity of the intake port 13. An insulator 21 aiming at a heat insulation is attached to an open portion of the intake port 13 and the air flow paths 14, 14, and the insulator 21 is provided with an intake passage 22 communicating with the intake port 13, and first air passages 23, 23 respectively communicating with the pair of air flow paths 14, 14.

One end portion of a carburetor 30 is attached to the intake passage 22, and the other end portion of the carburetor 30 is connected to an air cleaner 32. The carburetor 30 is provided with a butterfly type throttle valve 31 controlling an amount of an air-fuel mixture of an air and a fuel. The air cleaner 32 and a pair of first air passages 23, 23 are connected by a pair of second air passages 24, 24 which are arranged approximately in parallel to each other. The respective second air passages 24, 24 are provided with butterfly type air control valves 25, 25 controlling an air amount of the lead air.

The throttle valve 31 and the air control valves 25, 25 are connected by a link apparatus (not shown) or the like, and are configured so as to rotate in an interlocking manner. In the meantime, the configurations of the throttle valve 31 and the air control valves 25, 25, and the interlocking mechanism of the throttle valve 31 and the air control valves 25, 25 do not exhibit the feature of the present invention, but can employ the conventionally known configuration and the conventionally known interlocking mechanism.

Further, the throttle valve and the air control valve are not limited to the butterfly type shape, but can employ a throttle valve and an air control valve as far as the valve can control an air flow amount within the passage, including a rotary type or the like.

The lead air control apparatus 20 is comprised of the insulator 21, the second air passage 24, the air control valve 25, the carburetor 30, the throttle valve 31 and the air cleaner 32. The air cleaner 32, the carburetor 30 and the insulator 21 are fastened and attached to the cylinder 3 by bolts 28, 28, and the first air passages 23 and 23 are connected to the air flow paths 14, 14 provided in the cylinder 3.

Figure 2:
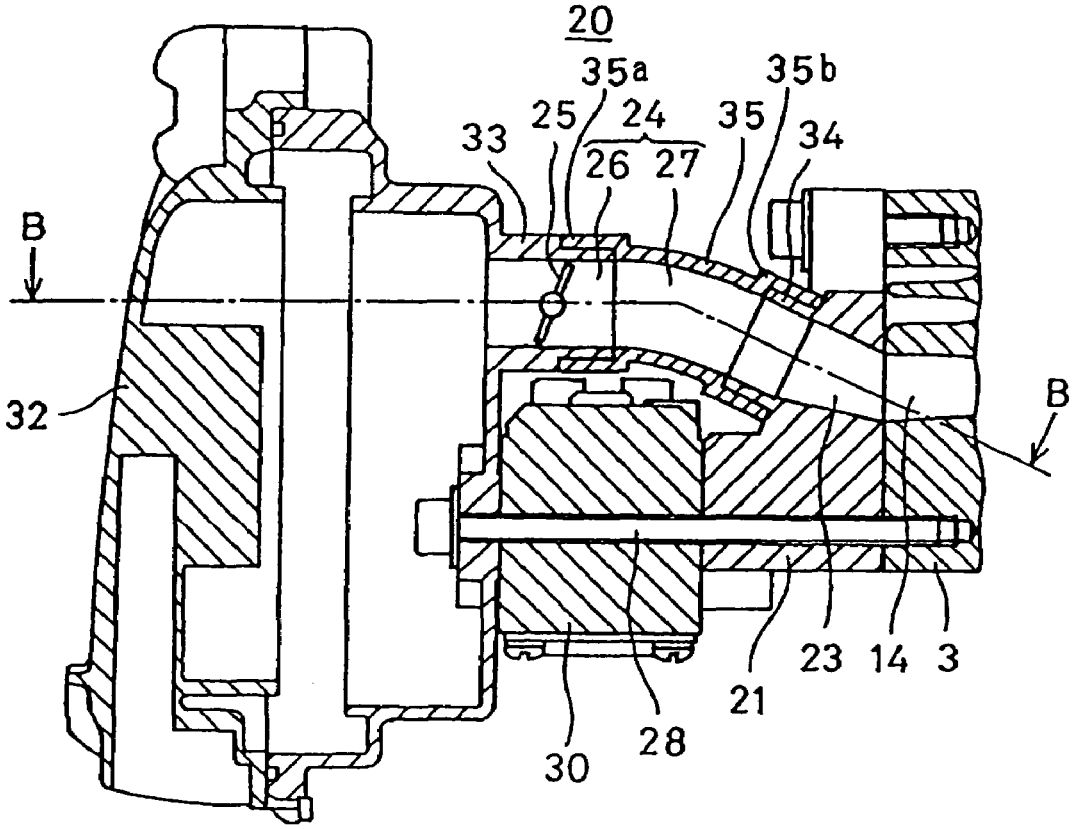
FIG. 2 is a side elevational cross sectional view of a lead air control apparatus according to a first embodiment, and corresponds to a cross sectional view along a line A—A in FIG. 3.

Hereinafter, a detailed configuration of the lead air control apparatus 20 is explained. FIG. 2 is a side elevational cross sectional view of the lead air control apparatus according to a first embodiment and FIG. 3 is a plan cross sectional view thereof, in which FIG. 2 is a cross sectional view along a line A—A in FIG. 3 and FIG. 3 is a cross sectional view along a line B—B in FIG. 2.

Figure 3:
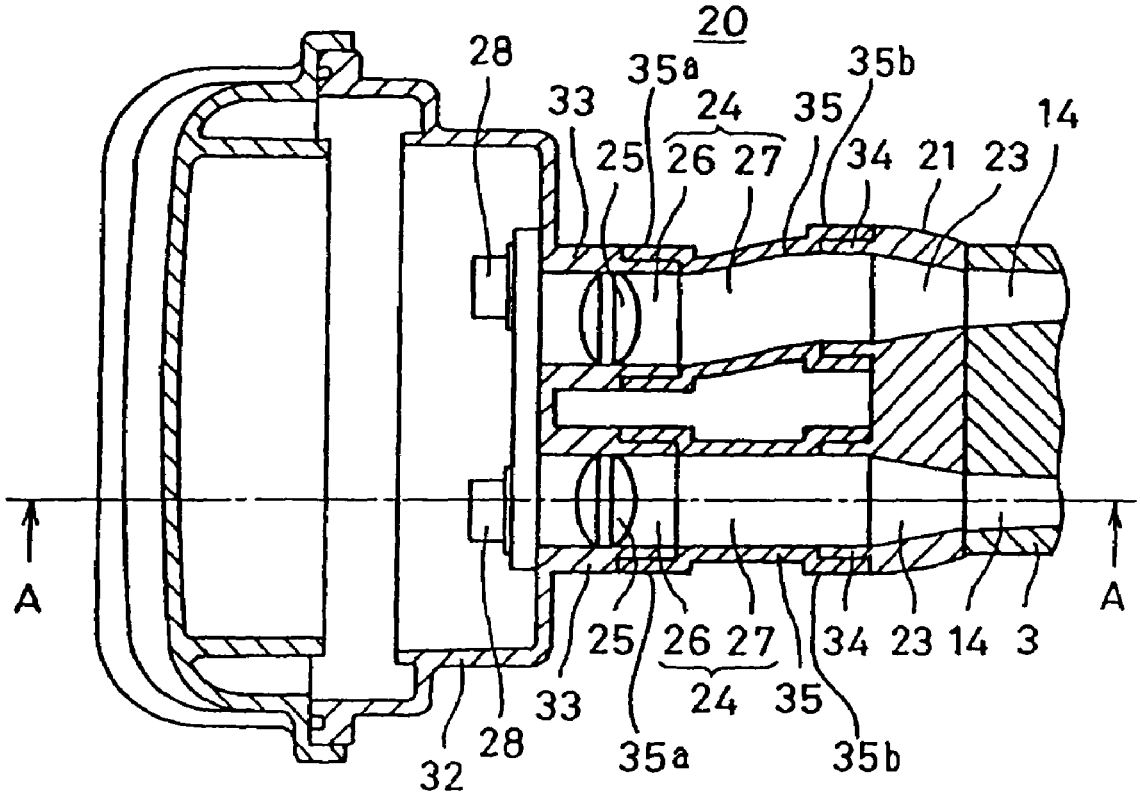
FIG. 3 is a plan cross sectional view of the lead air control apparatus according to the first embodiment, and corresponds to a cross sectional view along a line B—B in FIG. 2.

As shown in FIGS. 2 and 3, a pair of first protruding portions 33, 33 integrally formed with the air cleaner 32 are provided in a parallel state in an upper side of a connection position to the carburetor 30 in the air cleaner 32. The air control valves 25, 25 are respectively provided in third air passages 26, 26 arranged in the respective first protruding portions 33, 33.

The insulator 21 inserted between the carburetor 30 and the cylinder 3 for the purpose of insulating the heat is provided with a pair of second protruding portions 34, 34 each having the first air passage 23 so as to protrude toward an obliquely upper side in addition to the intake passage 22 mentioned above.

The respective first protruding portions 33, 33, and the respective second protruding portions 34, 34 are connected by tubular connection members 35, 35 each having a fourth air passage 27. The insulator forming the intake passage 22 and the insulator forming the first air passage 23 may be configured by independent bodies.

A pair of second air passages 24, 24 are configured by the respective third air passages 26, 26 and the respective fourth air passages 27, 27. The connection member 35 is manufactured by a material having a flexibility such as a rubber or the like, and the fourth air passage 27 is formed in a smooth shape.

Further, step portions 35*a*, 35*b* are formed in both ends of the connection member 35. It is possible to connect in a state in which an inner diameter cross sectional area is hardly changed in the respective connection portions between the connection member 35, and the first protruding portion 33 and the second protruding portion 34, due to the step portions 35*a*, 35*b* formed in both ends of the connection member 35.

Since inner peripheral surfaces of expanded portions in the step portions 35*a*, 35*b* are closely fitted to outer peripheral surfaces of the first protruding portion 33 and the second protruding portion 34, it is possible to execute the connection in an airtight state. Accordingly, it is possible to smoothly and continuously configure the inner peripheral wall between the first air passages 23, 23 and the second air passages 24, 24 along a length direction of the air passage.

As shown in FIGS. 1 and 2, the air passage of the lead air configured by the first air passage 23 and the second air passage 24 can be configured as a downward tilted air passage toward a downstream side in a range of the fourth air passage 27 and the first air passage 23 constituted at least by the connection member 35. Further, it is possible to arrange the air passage of the lead air configured by the first air passage 23 and the second air passage 24 in an upper side of the intake passage 22.

Accordingly, it is possible to set an arrangement relationship in which a passage direction of the intake passage 22 formed in the insulator 21 is differentiated from a passage direction of the first air passage 23. Further, it is possible to form the intake passage 22 at an easily connecting position to the carburetor 30 in the insulator 21. Further, it is possible to configure the second protruding portion 34 in the first air passage 23 at an arrangement position easily connected by the connection member 35.

Since the first air passage 23 and the second air passage 24 can be configured according to the arrangement relationship mentioned above, it is possible to expand an interval between the connection position of the first protruding portion 33 in the air cleaner 32, and the connection position of the carburetor 30 and the air cleaner 32, and it is possible to use a large size air cleaner as the air cleaner.

Accordingly, the large size air cleaner can be used by connecting it to a small size engine in which the intake port 13 for the air-fuel mixture and the air flow paths 14, 14 for the lead air are arranged at close positions.

As shown in FIG. 3, a pair of air passages of the lead air configured by the first air passage 23 and the second air passage 24 can respectively arrange the third air passages 26, 26 in the first protruding portions 33, 33 and the first air passages 23, 23 in the second protruding portions 34, 34 in an approximately parallel state.

The respective third air passages 26 and 26 are arranged in an approximately parallel state to each other, and each of them is respectively formed as an approximately linear air passage. Further, the respective first air passages 23, 23 are also arranged in an approximately parallel state to each other, and each of them is formed as an approximately linear air passage.

The approximately linear air passage involves an air passage shape in which an inner diameter within the air passage is expanded from an upstream side toward a downstream side, an air passage shape in which the inner diameter is inversely compressed from the upstream side toward the downstream side, and the like, in addition to the air passage in which the inner diameter within the air passage is entirely uniform, and includes all air passage shapes in which a center axial line of the air passage is formed in an approximately linear shape.

Even if the interval between the pair of first protruding portions 33, 33 and the interval between the second protruding portions 34, 34 are different, it is possible to configure the portion between the second air passage 24 and the first air passage 23 as a smooth pipe passage shape, by connecting and communicating by a pair of connection members 35, 35 having the flexibility.

Accordingly, it is possible to reduce a pipe passage resistance in the air passage from the second air passage 24 to the first air passage 23, and it is possible to circulate the lead air having a small pressure loss. Therefore, it is possible to sufficiently secure the air amount of the lead air supplied into the engine.

Further, it is possible to increase a freedom with respect to a place which can be selected as the forming position of a pair of first protruding portions 33, 33 integrally formed with the air cleaner 32 and the third air passages 26, 26, and the forming position of the first air passages 23, 23 in the insulator 21.

Accordingly, it is possible to make the configurations of the insulator simple. Further, it is possible to configure the arrangement relationship of the pair of first protruding portions 33, 33 and the pair of second protruding portions 34, 34 as a simple arrangement relationship. As a result, it is possible to simplify the configurations of the entire stratified scavenging two-cycle engine, and it is possible to configure the engine compact. Further, it is possible to configure the air passage of the lead air as a smooth air passage having a small air resistance.

Next, an operation is explained. At a top dead center position of the piston 4 shown in FIG. 1, the air-fuel mixture of the air and the fuel is compressed in an upper portion of the cylinder chamber, and is ignited by the spark plug 7, whereby the air-fuel mixture is exploded so as to push down the piston 4. At this time, the scavenging port 10 and the scavenging flow path 12 is filled with a clean air introduced thereto from the air cleaner 32 via the second air passage 24, the first air passage 23 and the air flow passage 14.

Further, the crank chamber 11 is filled with the air-fuel mixture obtained by mixing the air from the air cleaner 32 with the fuel by the carburetor 30. When the piston 4 moves downward, the intake port 13 is first closed, and the air-fuel mixture filled in the crank chamber 11 is compressed. Next, the exhaust port 8 is opened, and the exhaust gas is discharged to an exterior portion from the exhaust port 8 via the muffler 9.

Successively, the scavenging port 10 is opened, the lead air within the scavenging port 10 and the scavenging flow path 12 flows into the cylinder 3 by the compressed pressure within the crank chamber 11, and the remaining exhaust gas is discharged from the exhaust port 8. Thereafter, the air-fuel mixture within the crank chamber 11 flows into the cylinder 3 chamber, however, since the piston 4 is in the process of ascending stroke at this time, and the exhaust port 8 is made in a closed state by the piston 4, there is no risk that the air-fuel mixture is discharged to the external portion.

An amount of the air-fuel mixture passing through the carburetor 30 is controlled by the throttle valve 31, and the air amount of the lead air passing through the second air passage 24 is controlled by the air control valve 25. Further, since the throttle valve 31 works with the air control valve 25, it is possible to always keep a balance between the amount of the air-fuel mixture and the air amount of the lead air, an optimum supply is executed and the combustion in an optimum state is executed.

The lead air control apparatus of the stratified scavenging two-cycle engine according to the present invention is configured such that a pair of air passages are arranged in a parallel state, and the air control valve is provided in each of them. Accordingly, it is not necessary to branch the air passage into the right and left sides in the insulator portion as is different from the conventional configuration, and it is possible to simplify the configuration in the insulator portion.

Further, since it is possible to form the air passage connecting the air cleaner to the air flow path connected to the scavenging port of the engine as the smooth shape, it is possible to reduce the air resistance within the air passage, and it is possible to improve an engine performance.

Further, it is possible to make the first air passage formed in the insulator as the linear simple configuration, and it is possible to configure the passage length of the first air passage short. Accordingly, it is possible to configure an entire length L of the engine shown in FIG. 1 shorter than an entire length M of the conventional engine shown in FIG. 6, and it is possible to configure the entire of the engine compact.

Further, the insulator 21 can be provided with the pair of second protruding portions 34, 34 each having the first air passage 23 so as to protrude in the obliquely upward shape. Accordingly, it is possible to arrange the air outlet in the intake passage for the air-fuel mixture and the air outlet for the lead air so as to be formed at the large apart positions. The large size air cleaner can be used as the air cleaner.

Accordingly, the large size air cleaner can be connected to the small size engine in which the intake port 13 for the air-fuel mixture and the air flow paths 14, 14 for the lead air are formed at the close position.

Further, the first air passage 23 and the second air passage can be easily assembled by using the connection member having the flexibility as the connection member 35, and the assembled air passage can be easily formed as the passage having a small air resistance.

Since the step portions 35*a*, 35*b* are formed in both ends of the connection member 35, it is possible to connect in a state in which the inner diameter cross sectional area is hardly changed in the connection portion between the connection member 35, and the first protruding portion 33 and the second protruding portion 34. Accordingly, it is possible to reduce the pressure loss caused by the inner diameter cross sectional area in the connection portion.

Figure 4:
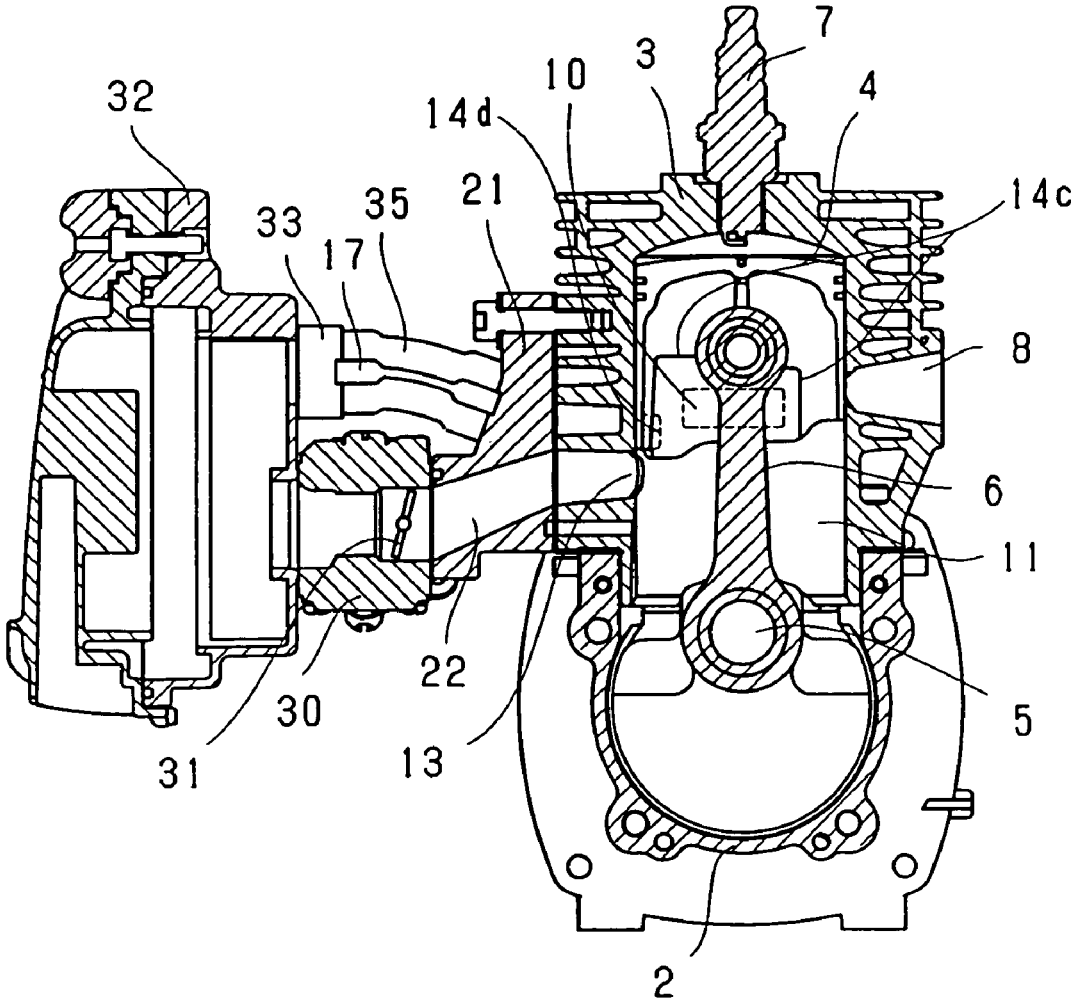
FIG. 4 is a front elevational cross sectional view of a stratified scavenging two-cycle engine according to a second embodiment, and corresponds to a cross sectional view along a line D—D in FIG. 6.
Figure 5:
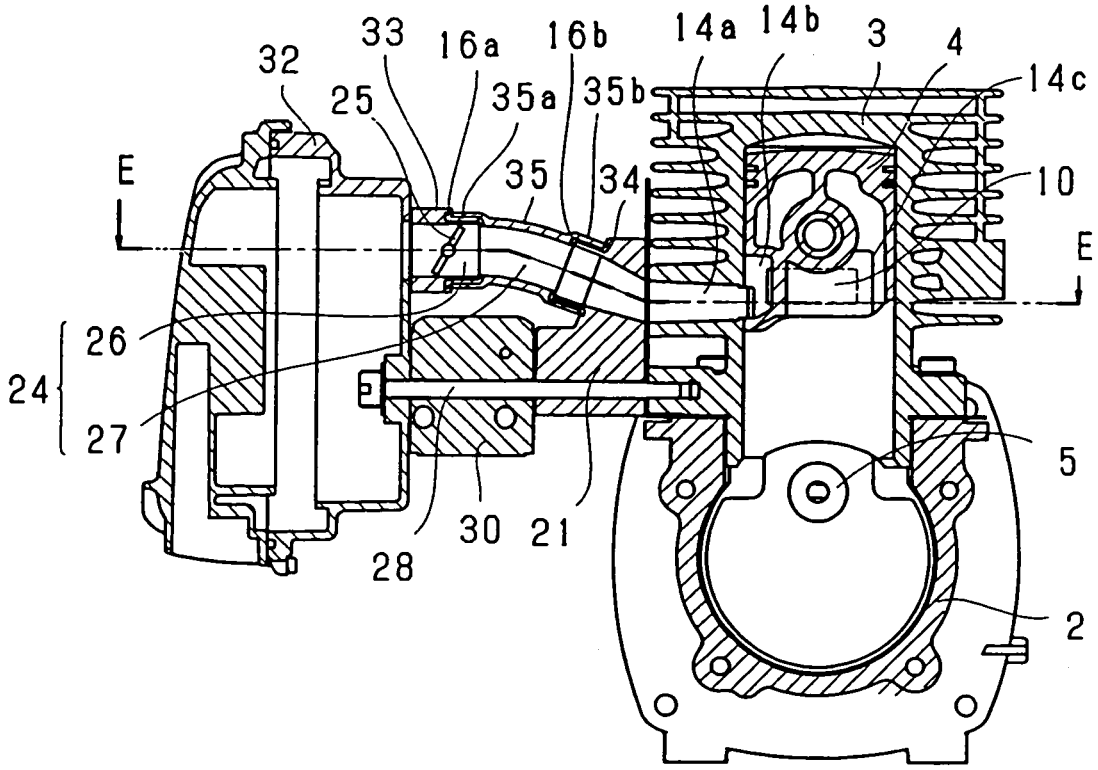
FIG. 5 is a side elevational cross sectional view of the stratified scavenging two-cycle engine according to the second embodiment, and corresponds to a cross sectional view along a line C—C in FIG. 6.
Figure 6:
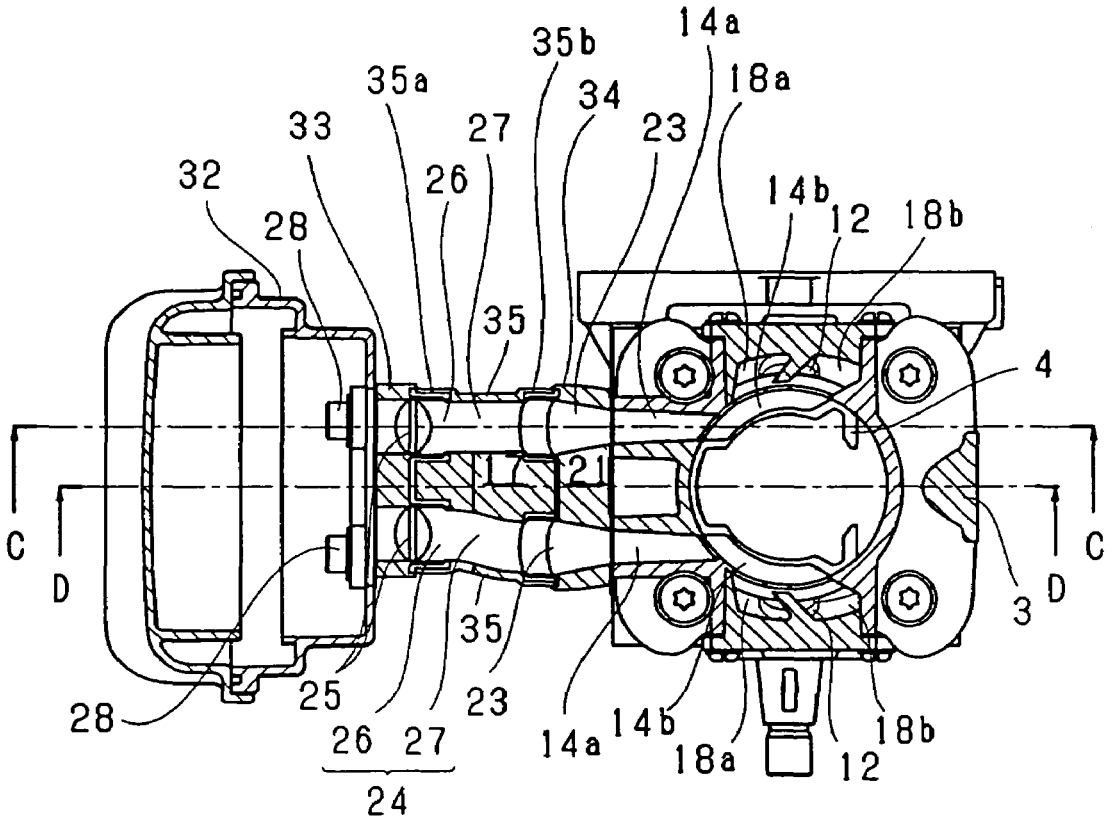
FIG. 6 is a plan cross sectional view of the stratified scavenging two-cycle engine according to the second embodiment, and corresponds to a cross sectional view along a line E—E in FIG. 5.

FIGS. 4 to 6 show a configuration of a stratified scavenging two-cycle engine according to a second embodiment of the present invention. FIG. 4 is a front elevational cross sectional view of the stratified scavenging two-cycle engine, and corresponds to a cross sectional view along a line D—D in FIG. 6. FIG. 5 is a side elevational cross sectional view of the stratified scavenging two-cycle engine, and corresponds to across sectional view along a line C—C in FIG. 6. Further, FIG. 6 is a plan cross sectional view of the stratified scavenging two-cycle engine, and corresponds to a cross sectional view along a line E—E in FIG. 5.

A description of the same portion is not repeated by using the same reference numerals as those of the same portion in the first embodiment, and only different portions is explained. As shown in FIGS. 4 and 5, the intake passage 22 is communicated with the intake port 13 formed in the cylinder 3, and the intake port 13 is communicated with the crank chamber 11.

As shown in FIGS. 5 and 6, the first air passage 23 formed in the insulator 21 is communicated with a first air flow path 14*a* formed in the cylinder 3. The first air flow path 14*a* is communicated with a second air flow path 14*b* formed on an outer peripheral surface of the piston 4 via a lead air port 14*d* formed on the outer peripheral surface of the piston 4.

The lead air port 14*d* is configured as a part of the second air flow path 14*b*, and the second air flow path 14*b* is configured as a shape surrounded by a piston groove wall 14*c*. The second air flow path 14*b* is communicated with third air flow paths 18*a*, 18*b* formed in the cylinder 3. The third air passages 18*a*, 18*b* are respectively communicated with the scavenging port 10, and are communicated with the crank chamber 11.

The scavenging ports 10 respectively communicating with the third air passages 18*a*, 18*b* can be arranged at different positions on the inner peripheral surface of the cylinder 3, can be arranged at adjacent positions, or can be arranged as the same scavenging port 10.

As shown in FIG. 5, the first air flow path 14*a* and the scavenging port 10 are arranged so as to be connectable on the same plane via the second air flow path 14*b*. When the piston 4 is actuated and the first air flow path 14*a*, the second air flow path 14*b* and the scavenging port 10 are arranged in an approximately linear shape, the lead air can flow into the scavenging port 10 from the first air flow passage 14*a* through the second air flow path 14*b* which are arranged in the approximately linear shape. Accordingly, it is possible to charge the lead air having a small passage resistance and a sufficient amount from the scavenging port 10 into the cylinder 3 or the like.

As shown in FIG. 6, a pair of first air passages 23 and 23 are formed in the insulator 21. As mentioned above, a pair of first air passages 23, 23 are respectively branched by the third air flow paths 18*a*, 18*b*, and are respectively communicated with two sets of left and right scavenging ports 10 which are arranged symmetrically within the cylinder chamber.

Two sets of right and left scavenging ports 10 are not limited to be formed in two right and left positions within the cylinder chamber, but can be arranged at a necessary number. In the case of placing a necessary number of scavenging ports, the scavenging port can be simply configured by arranging a necessary number of third air flow paths 18 which are branched from the second air flow path 14*b* formed in the piston 4 and formed in the cylinder 3.

It is easy to arrange the first air flow path 14*a* in a parallel state, by forming the second air flow path 14*b* on the outer peripheral surface of the piston 4. Accordingly, it is possible to arrange a pair of first air passages 23 communicating with a pair of first air flow paths 14*a* in a parallel state which is approximately equal to the first air flow paths 14*a*, and it is easy to form the first air flow path 14*a* and the first air passage 23 in an approximately linear shape.

As shown in FIGS. 5 and 6, seal members 16*a*, 16*b* may be interposed in the connection between the step portions 35*a*, 35*b* of the connection member 35, and the first protruding portion 33 and the second protruding portion 34. A pair of connection members 35, 35 can be integrally configured therebetween via the connection member 17, or the connection members 35, 35 can be independently configured as separated bodies.

Since a pair of connection members 35, 35 are integrally configured therebetween via the connection member 17, it is possible to arrange the air passage of the lead air and the intake passage communicating with the carburetor 30 as independent passages which are different in a vertical direction.

Accordingly, the air passage of the lead air and the intake passage 22 can be configured with a neat arrangement relationship and with a compact configuration, without arranging the air passage of the lead air in both sides of the carburetor 30 or without employing the arrangement relationship that the air passage of the lead air and the intake passage 22 cross.

Since the air passage of the lead air and the intake passage 22 are configured as the neat arrangement relationship, it is possible to make the configuration of the lead air control apparatus 20 compact.

As shown in FIGS. 5 and 6, since it is possible to form a pair of first air flow paths 14*a*, 14*a* and a pair of first air passages 23, 23 in an approximately linear shape in an approximately parallel state, it is possible to configure the first air flow paths 14*a*, 14*a* and the intake port 13 in a state in which the arranged positions thereof are close to each other. Further, the air cleaner 32 can be connected to the first air passage 23 via the connection member 35 and in the smooth flow path shape. Accordingly, the large size air cleaner 32 can be connected in a reduced air resistance state even to the small size engine serving as the stratified scavenging two-cycle engine.

Figure 7:
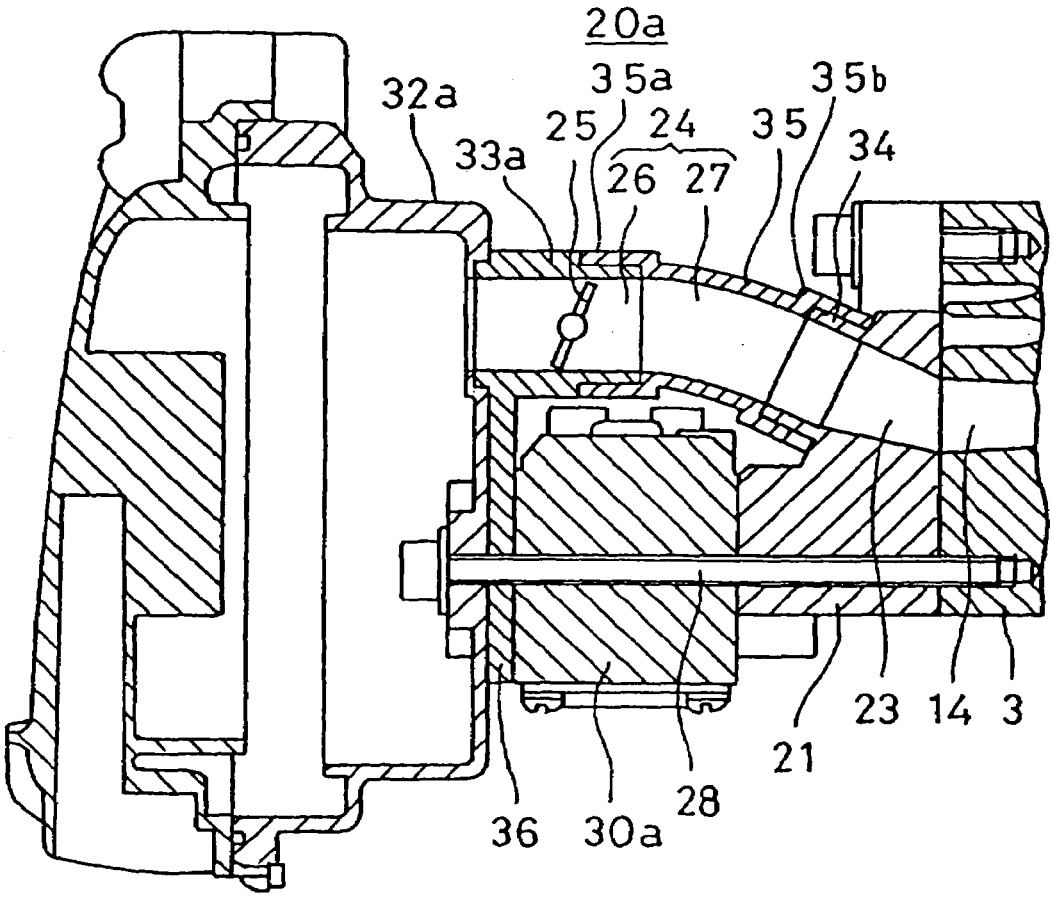
FIG. 7 is a side elevational cross sectional view of a lead air control apparatus according to a third embodiment.

FIG. 7 is a side elevational cross sectional view of a lead air control apparatus 20*a* according to a third embodiment of the present invention. A description of the same portion is not repeated by using the same reference numerals to the same portions as those of the first embodiment, and only different portions is explained.

The third embodiment is configured different from the first embodiment in a point that the first protruding portion 33 integrally formed with the air cleaner 32 in the first embodiment is configured as a first protruding portion 33*a* which is independent from an air cleaner 32*a*. The other configurations are the same as those of the first embodiment.

As shown in FIG. 7, a pair of first protruding portions 33*a* are attached while holding a joint member 36 interposed between the air cleaner 32*a* and a carburetor 30*a*. The air control valve 25 is provided in the first protruding portion 33*a*. Accordingly, it is possible to simplify the shape of the air cleaner, and it is possible to reduce a cost. Further, a connection portion between both end portions of a pair of first protruding portions 33*a* and the air cleaner 32*a*, and a connection portion to the connection member 35 are respectively connected in a state in which a change in an inner diameter cross sectional area in the connection portions is hardly generated.

Figure 8:
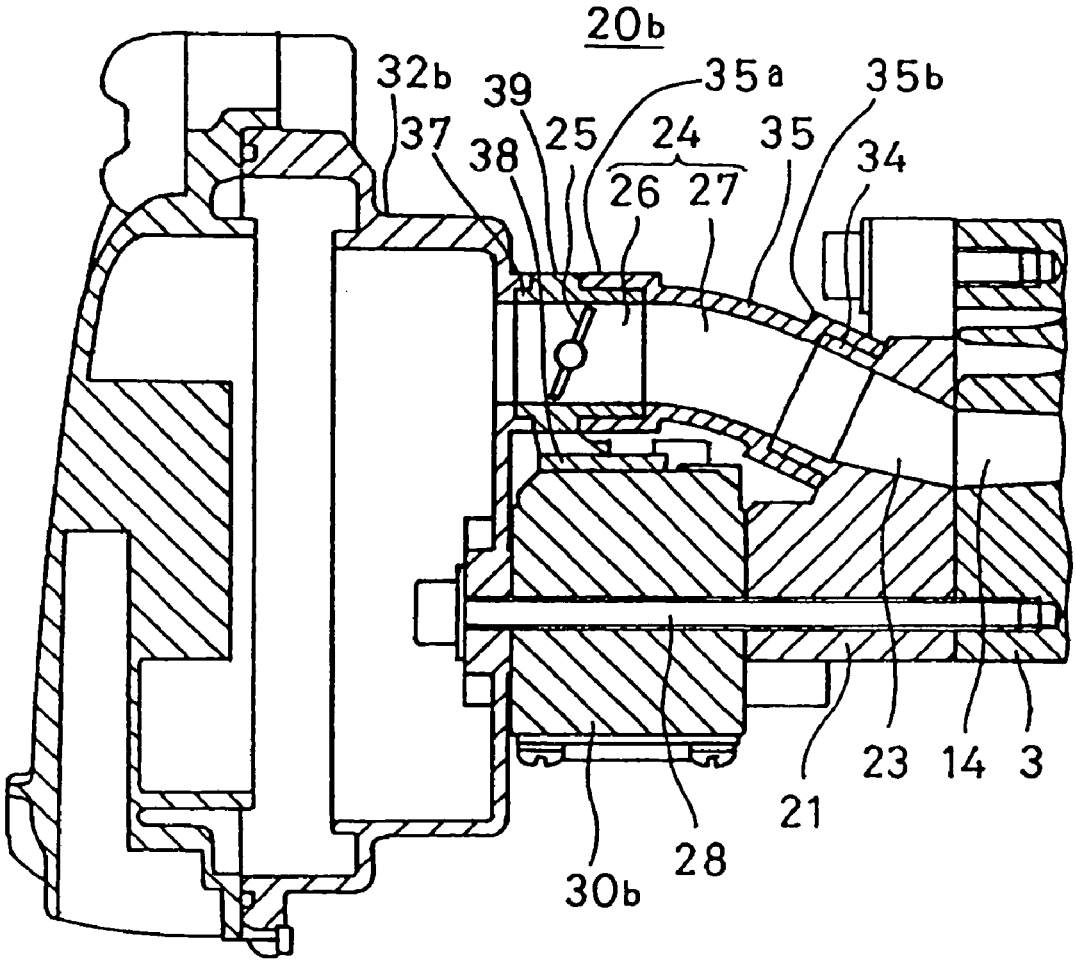
FIG. 8 is a side elevational cross sectional view of a lead air control apparatus according to a fourth embodiment.

FIG. 8 is a side elevational cross sectional view of a lead air control apparatus 20*b* according to a fourth embodiment of the present invention. A description of the same portions is not repeated by using the same reference numerals to the same portions in the first embodiment, and only different portions is explained.

In the fourth embodiment, an air passage pipe 37 corresponding to the first protruding portion 33*a* in the third embodiment is formed in a different way from the second embodiment. In the third embodiment, the first protruding portion 33*a* is configured such as to be formed in the joint member 36 interposed between the air cleaner 32*a* and the carburetor 30*a*. On the contrary, in the fourth embodiment, the air passage pipe 37 is formed in an air passage member 39 which is integrally formed with a bracket 38 firmly fixed to an upper portion of the carburetor 30*b*. The other configurations are the same as those of the first to third embodiments.

In FIG. 8, the air passage member 39 integrally forming a pair of air passage pipes 37 and the bracket 38 is firmly fixed to the upper portion of the carburetor 30*b* by bolts (not shown). The air cleaner 32*b* and the air passage pipe 37 are connected based on a faucet joint. An O-ring (not shown) is inserted to the faucet portion so as to keep an airtightness. The air control valve 25 is provided in the air passage pipe 37. Further, a connection portion between both end portions of a pair of air passage members 39 and the air cleaner 32*a*, and a connection portion to the connection member 35 are connected in a state in which a change in an inner diameter cross sectional area in the connection portions is hardly generated.

Accordingly, it is possible to simplify the shape of the air cleaner, and it is possible to reduce a cost.

The lead air control apparatus according to the present invention may be configured as described below in addition to the configurations mentioned above. The connection member is constituted by a pair of tubular member, but may be configured such that two air passages are provided in one member, and the material thereof may employ a metal or a synthetic resin in addition to the rubber.

The invention claimed is:

1. A lead air control apparatus of a stratified scavenging two-cycle engine, the stratified scavenging two-cycle engine comprising: a carburetor connected to an air cleaner and having a throttle valve; an insulator inserted between the carburetor and a cylinder for a purpose of insulating heat; and an intake passage formed in the insulator and connecting between an intake port provided in the cylinder and the carburetor, wherein the apparatus comprises:

a pair of first air passages formed in the insulator, and respectively connected to a pair of scavenging ports provided in the cylinder;

a pair of second air passages respectively connecting between the air cleaner and the respective first air passages, and arranged in an approximately parallel state; and air control valves provided in the respective second air passages, and controlling an air amount of a lead air for scavenging.

2. The lead air control apparatus of the stratified scavenging two-cycle engine according to claim 1, wherein the air control valves are provided near the air cleaner or are integrally formed with the air cleaner;

the respective second air passages are provided with connection members respectively connected to the first air passages; and an inner peripheral wall from each of the first air passages to each of the second air passages is formed smoothly and continuously along a length direction of the air passages.

3. The lead air control apparatus of the stratified scavenging two-cycle engine according to claim 2, wherein a connection portion in an end portion of each of the connection members is formed such that a change of an internal diameter cross sectional area between the connection portion and a connected portion is small.

4. The lead air control apparatus of the stratified scavenging two-cycle engine according to claim 2 or 3, wherein each of the connection members has a flexibility.

5. The lead air control apparatus of the stratified scavenging two-cycle engine according to any one of claims 1 to 3, wherein the respective first air passages are arranged so as to be approximately parallel to each other, and each of the first air passages is formed as an approximately linear air passage.

6. The lead air control apparatus of the stratified scavenging two-cycle engine according to any one of claims 1 to 3, wherein the respective first air passages have air flow paths formed within the cylinder; and the pair of air flow paths and the pair of scavenging ports are arranged so as to be connectable on a same plane.

7. The lead air control apparatus of the stratified scavenging two-cycle engine according to claim 4, wherein the respective first air passages are arranged so as to be approximately parallel to each other, and each of the first air passages is formed as an approximately linear air passage.

8. The lead air control apparatus of the stratified scavenging two-cycle engine according to claim 4, wherein the respective first air passages have air flow paths formed within the cylinder; and the pair of air flow paths and the pair of scavenging ports are arranged so as to be connectable on a same plane.

9. The lead air control apparatus of the stratified scavenging two-cycle engine according to claim 5, wherein the respective first air passages have air flow paths formed within the cylinder; and the pair of air flow paths and the pair of scavenging ports are arranged so as to be connectable on a same plane.

10. The lead air control apparatus of the stratified scavenging two-cycle engine according to claim 7, wherein the respective first air passages have air flow paths formed within the cylinder; and the pair of air flow paths and the pair of scavenging ports are arranged so as to be connectable on a same plane.

* * * * *